US010411377B2

(12) United States Patent
Kawahara

(10) Patent No.: US 10,411,377 B2
(45) Date of Patent: Sep. 10, 2019

(54) SURFACE MOUNT CONNECTOR WITH ALTERNATIVE DIRECTION MOUNTING FEATURE

(71) Applicant: NIPPON TANSHI CO., LTD., Kanagawa (JP)

(72) Inventor: Yuzo Kawahara, Kanagawa (JP)

(73) Assignee: NIPPON TANSHI CO., LTD., Kanagawa (JP)

( * ) Notice: Subject to any disclaimer, the term of this patent is extended or adjusted under 35 U.S.C. 154(b) by 0 days.

(21) Appl. No.: 16/306,210

(22) PCT Filed: May 25, 2017

(86) PCT No.: PCT/JP2017/019601
§ 371 (c)(1),
(2) Date: Nov. 30, 2018

(87) PCT Pub. No.: WO2017/212940
PCT Pub. Date: Dec. 14, 2017

(65) Prior Publication Data

US 2019/0173210 A1 Jun. 6, 2019

(30) Foreign Application Priority Data

Jun. 6, 2016 (JP) ..... 2016-112523

(51) Int. Cl.
*H01R 13/66* (2006.01)
*H01R 12/71* (2011.01)
*H01R 12/70* (2011.01)

(52) U.S. Cl.
CPC ..... *H01R 12/716* (2013.01); *H01R 12/707* (2013.01)

(58) Field of Classification Search
CPC ..... H01R 12/707; H01R 12/724
(Continued)

(56) References Cited

U.S. PATENT DOCUMENTS 3,399,374 A * 8/1968 Vito ..... H01R 13/514 174/138 F
4,504,108 A * 3/1985 Fiumefreddo ..... H02B 1/20 439/557
(Continued)

FOREIGN PATENT DOCUMENTS

JP 2006100231 4/2006
JP 2006339000 12/2006
(Continued)

OTHER PUBLICATIONS

International Search Report for PCT/JP2017/019601 dated Aug. 4, 2017, 4 pages.

*Primary Examiner* — Neil Abrams
(74) *Attorney, Agent, or Firm* — Dority & Manning, P.A.

(57) ABSTRACT

A connector that includes: a box-shaped substrate side housing containing a terminal mount wall extending in a plane defined by mutually orthogonal X and Y axes, four side walls; and terminals arranged in two rows, the rows being apart from each other in an X axis direction, such that the terminals in each row are in alignment with one another in a Y axis direction, is provided. A lock part is provided on one of the two first side walls for detachably locking a plug housing in an inserted position, and, on each of the second side walls, a first and a second reinforcement plate mount parts are provided at two different positions apart from each other in the X-axis direction, and a reinforcement plate may be mounted to each of the two first and the two second reinforcement plate mount parts. The housing may be alternatively mounted in an upward opening manner or in a right angle manner and with the reinforcement plate edges soldered to a printed circuit board in each case.

3 Claims, 8 Drawing Sheets

(58) Field of Classification Search
USPC ..... 79/79, 570
See application file for complete search history.

(56) References Cited

U.S. PATENT DOCUMENTS 4,509,811 A * 4/1985 Amano ..... H01R 12/79 439/495
4,668,040 A * 5/1987 Matsuzaki ..... H01R 12/7029 439/557
4,732,565 A * 3/1988 Ito ..... H01R 12/716 439/79
5,120,256 A * 6/1992 Walden ..... H01R 12/707 439/553
5,232,379 A * 8/1993 Lai ..... H01R 12/57 248/222.12
5,803,765 A 9/1998 Peloza et al.
5,882,210 A * 3/1999 Embo ..... H01R 24/50 439/63
6,022,244 A * 2/2000 Chiu ..... H01R 12/707 439/570
6,053,767 A 4/2000 Copper et al.
6,328,600 B1 12/2001 Fujiki et al.
6,827,607 B2 * 12/2004 Fujita ..... H01R 12/7047 439/573
7,083,435 B2 * 8/2006 Lohr ..... H01R 12/57 439/79
7,134,886 B2 * 11/2006 Okamura ..... H01R 12/716 439/79
7,134,910 B2 * 11/2006 Nakano ..... H01R 4/028 439/570
7,207,837 B2 * 4/2007 Nakano ..... H05K 3/341 439/570
7,223,114 B2 * 5/2007 Tateishi ..... H01R 13/6272 439/354
7,458,848 B2 * 12/2008 Nakano ..... H01R 13/41 439/570
7,467,956 B2 * 12/2008 Hirai ..... H05K 3/3426 439/541.5
7,758,354 B2 * 7/2010 Shibata ..... H05K 3/306 439/79
9,806,442 B2 * 10/2017 Geske ..... H01R 4/48

FOREIGN PATENT DOCUMENTS

JP 2012123939 6/2012
JP 2014165091 9/2014
JP 2014165093 9/2014

* cited by examiner up
rear(X)
left
front
right(Y)
down
62C
62
62B
62B
62A
62C
62
62B
62A
20
44
45
18
12
26
22
48A
60
24
60
46
48
48A
16
46A
32
32
32A
32
32B
32C
104
108
106
32E
32
30
30
30
30A
32D
30
30
30B
108
106
30C
30D
104
30E
100
102 up
left
rear(X)
front
right(Y)
down
62C
62
62B
62B
62A
62
45
44
18
20
12
22
16
60
60
46
48
48A
46A
34
34
34
34A
34
34B
34C
104
108
36E
36C
36
36
36
36
36D
100
106
108
36A
36B up
front
rear(X)
down 24
12
26
60
10
34A
18
36A
16
34
36C
36E
14
28
36B
36
28
38
100
36D

SURFACE MOUNT CONNECTOR WITH ALTERNATIVE DIRECTION MOUNTING FEATURE

CROSS REFERENCE TO RELATED APPLICATIONS

This application is the U.S. National Stage entry of International Application Number PCT/JP2017/019601 filed under the Patent Cooperation Treaty having a filing date of May 25, 2017, which claims priority to Japanese Patent Application No. 2016-112523 having a filing date of Jun. 6, 2016, which are incorporated herein by reference.

TECHNICAL FIELD

The present invention relates to a surface mount connector, in particular, to a multipole surface mount connector with terminals arranged in two rows.

BACKGROUND ART

Known surface mount connectors to be mounted on a surface of a printed board include a connector of the type which includes: a box-shaped substrate side housing formed of an electrically insulating material with an opening on one side, the housing including a rectangular (oblong) terminal mount wall and four side walls standing from respective sides of the terminal mount wall; multiple metallic terminals provided to the terminal mount wall; and plate-shaped reinforcement metal pieces to be mounted on the side walls of the substrate side housing and soldered to a printed board at their outer edges, and where the connector can be used in the two types of mounting forms: one is a straight type (vertical type) mounting form (hereafter "straight mounting form") in which the opening (inlet for a plug housing) of the connector opens upwards from the printed board, and the other is a right-angle type (horizontal type) mounting form (hereafter "right-angle mounting form") in which the opening of the connector opens sideways with respect to the printed board. (Examples are disclosed in Patent Documents 1 to 3).

In such a surface mount connector, the size of a reinforcement metal piece is substantially the same as that of a side wall of a substrate side housing in which the terminals are arranged in one row, and when the surface mount connector is used either in the straight mounting form or right-angle mounting form, one outer edge of the reinforcement metal piece which abuts surface of a printed board is soldered to the printed board.

PRIOR ART DOCUMENT(S)

Patent Document(s)

Patent Document 1: JP2000-268905A
Patent Document 2: JP2014-165091A
Patent Document 3: JP2014-165093A

SUMMARY OF THE INVENTION

Task to be Accomplished by the Invention

Some surface mount connectors include terminals arranged in one row, and others include terminals arranged in two rows. Naturally, a side wall of a substrate side housing of a two-row terminal type connector has substantially twice as great a width as that of a one-row terminal type connector. In cases of a two-row terminal type connector in which a reinforcement metal piece (reinforcement plate) used for its substrate side housing has substantially the same size as that of a side wall of the substrate side housing with terminals arranged in two rows, when the surface mount connector is used either in the straight mounting form or in the right-angle mounting form, one outer edge of each reinforcement metal piece abuts a surface of a printed board and is soldered to the printed board in the same manner as a substrate side housing of a one-row terminal type connector. However, in cases of a two-row terminal type in which a reinforcement metal piece (reinforcement plate) used for the substrate side housing with terminals arranged in two rows has substantially the same size as that of a side wall of a substrate side housing with terminals arranged in one row, with an aim to reduce material costs and use a common reinforcement metal piece when the surface mount connector is used in the different mounting forms, when the surface mount connector is used in the right-angle mounting form, the reinforcement metal piece to be soldered to the printed board needs to be mounted on the side closer to a surface of a printed board (the lower side).

In cases where the substrate side housing is provided with a lock part for detachably locking a plug housing in an inserted position, when the surface mount connector is used in the right-angle mounting form, the lock part needs to be located on the upper side of the substrate side housing so that the lock part can be manipulated from above the lock part in order to unlock the lock part. Thus, in the case that the surface mount connector is used in the right-angle mounting form, even when the reinforcement metal piece is disposed on the side closer to the surface of the printed board, the plug housing can be locked in position with a sufficient locking strength against an unlocking operation force and a force of tension exerted by a cable connected to a plug connector.

However, in the case that the surface mount connector is used in the straight mounting form, when the reinforcement metal piece for a one-terminal terminal type connector is disposed in the same way, the reinforcement metal piece is located on a rear side remote from the lock part, which is provided on a front side of the substrate side housing, which means that, on the side of the lock part, the substrate side housing is not fixed to the printed board through the reinforcement metal piece, thereby making it difficult to lock the plug housing in position with a sufficient locking strength against an unlocking operation force and a force of tension exerted by a cable connected to a plug connector. As a result, it becomes necessary to increase an area to be soldered to the printed board by using a thicker reinforcement metal piece, which results in failure to attain the intended effect of reducing material costs.

A primary object of the present invention is to achieve a reduction in material costs and a sufficient locking strength provided by a reinforcement plate at the same time in a connector with terminals arranged in two rows.

Means to Accomplish the Task

In accordance with one embodiment of the present invention, a surface mount connector includes:

a box-shaped electrically insulating substrate side housing (12) with an opening (24) on one side, the substrate side housing (12) including a rectangular terminal mount wall (14), and four side walls (16, 18, 20, 22) standing from respective four sides of the terminal mount wall;

a plurality of electrically conductive terminals (30, 32, 34, 36) provided on the terminal mount wall (14); and a plug connector (70) including a plug housing (72) configured to be detachably inserted into the substrate housing (12), wherein the substrate side housing (12) is capable of being mounted on a printed board (100) such that the surface mount connector is used either in a straight mounting form in which the opening (24) opens upwards from the printed board, or in a right-angle mounting form in which the opening (24) opens sideways with respect to the printed board, wherein the terminal mount wall (14) is a wall extending in a plane defined by mutually orthogonal X and Y axes, wherein the terminals (30, 32, 34, 36) are arranged in two rows, the rows being apart from each other in an X axis direction, such that the terminals in each row are in alignment with one another in a Y axis direction, wherein the four side walls of the substrate side housing consist of two first side walls (16, 18) which are separated from each other in the X axis direction, and two second side walls (20, 22) which are separated from each other in the Y axis direction, wherein a lock part (60) is provided on one of the two first side walls for detachably locking the plug housing (72) in an inserted position, wherein, on each of the second side wall (20, 22), a first reinforcement plate mount part (46) and a second reinforcement plate mount part (48) are provided at two different positions apart from each other in the X axis direction, and a reinforcement plate (62) is allowed to be mounted to each of the two first and the two second reinforcement plate mount parts (46, 48), and wherein the reinforcement plates (62) mounted to the two first reinforcement plate mount parts (46) and/or the two second reinforcement plate mount pans (48) have respective outer edges which abut and re fixed to the printed board.

In this configuration, by choosing the two first or the two second reinforcement plate mount parts (46, 48) to which the reinforcement plates (62) are mounted depending on whether the surface mount connector is used in the straight mounting form or in the right-angle mounting form, the reinforcement plates (62), whose outer edges abut the printed board (100) and are fixed thereto, can properly reinforce the fixation of the surface mount connector (10) to the printed board (100) in the both cases of the straight mounting form and the right-angle mounting form. Moreover, the reinforcement plates 62 may have a smaller width than that of the substrate side housing (12) measured in the X axis direction, thereby achieving a reduction in material costs for the reinforcement plates (62).

In one preferable embodiment of the above-described connector, each reinforcement plate (62) has a width of approximately half the size of outer surfaces of the second side walls (20, 22) in the X axis direction.

In this configuration, the reinforcement plate (62) can be commonly used as both reinforcement plates for the two first and the two second reinforcement plate mount parts (46, 48).

In another preferable embodiment of the above-described connector, the surface mount connector is a single in-line type connector in which the terminals (34, 36) are electrically connected to the printed board (100) at connection points arranged in a single row, the row being located on one side of the printed board in the X axis direction, the terminals in the row being located at regular intervals in the Y axis direction, wherein each terminal (34, 36) is configured to extend through the terminal mount wall (14) into an inside of the substrate side housing (12), and includes: a contact (34A, 36A) configured to be electrically connected to a terminal on the plug housing (72); a substrate side extension part (34B, 36B) including having one end connected to the contact (34A, 36A) and extending along the terminal mount wall (14); and a substrate side connection part (34C, 36C) provided at the other end of the substrate side extension part (34B, 36B) and configured to be electrically connected to a terminal connection land (106) formed on the printed board, wherein, in each of the terminals (34) in one of the two rows (34B, 36B) located closer to the connection points, the substrate side extension part (34B) only includes a liner part extending linearly in the X axis direction, and wherein, in each of the terminals (36) in the other of the two rows (34, 36) located remote from the connection points, the substrate side extension part (34B) includes: an X axis direction part (34Ba) extending linearly in the X axis direction; and a Y axis direction part (34Bb) extending in the Y axis direction and having a length corresponding to an interval at which an adjoining pair of the connection points are located, the X axis direction part and the Y axis direction part forming a book shape.

In this configuration, a single in-line type connector can be formed in both the straight mounting form and the right-angle mounting form even when the connector has terminals arranged in two rows therein.

Effect of the Invention

According to the present invention, in a connector with terminals arranged in two rows, a reduction in material costs and a sufficient locking strength can be achieved at the same time by using a reinforcement plate which can be commonly used for connectors in different mounting forms.

DESCRIPTION OF THE PREFERRED EMBODIMENT(S)

Embodiments of the present invention are described in the following with reference to FIGS. 1 to 7.

Figure 1:
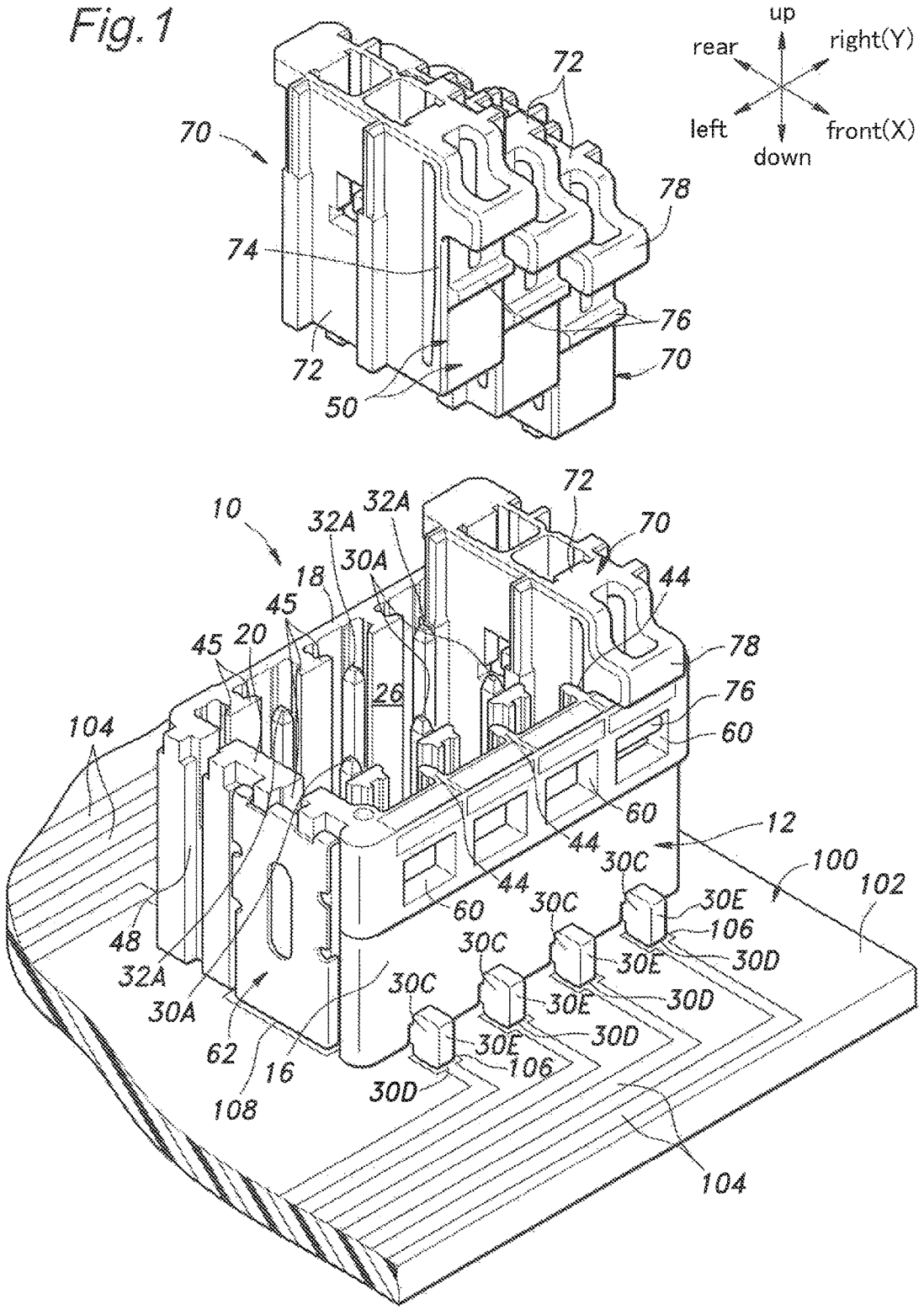
FIG. 1 is a perspective view showing a dual in-line type surface mount connector used in a straight mounting form in accordance with one embodiment of the present invention.

Reference numeral 10 generally denotes a surface mount connector of an embodiment of the present invention. The surface mount connector 10 is a connector mounted on a printed board 100 and includes a box-shaped substrate side housing 12 with an opening on one side. The substrate side housing 12 is made of an electrically insulating plastic material. A plug connector 70 is connected to the surface mount connector 10 as shown in FIG. 1.

The printed board 100 includes a metal layer which forms a conductor pattern(s) 104 and terminal connection lands (connection points) 106 for connecting with terminals on a surface of an insulated substrate 102.

The surface mount connector 10 can be mounted on the printed board 100 such that the surface mount connector is used in a straight mounting form or in a right-angle mounting form. When the connector 10 is used in the straight mounting form, the plug connector 70 (see FIG. 1) is allowed to be detachably inserted into the connector in a vertical direction. When the connector 10 is used in the right-angle mounting form, the plug connector 70 is allowed to be detachably inserted into the connector in a horizontal direction (see FIGS. 4 and 5).

Figure 2:
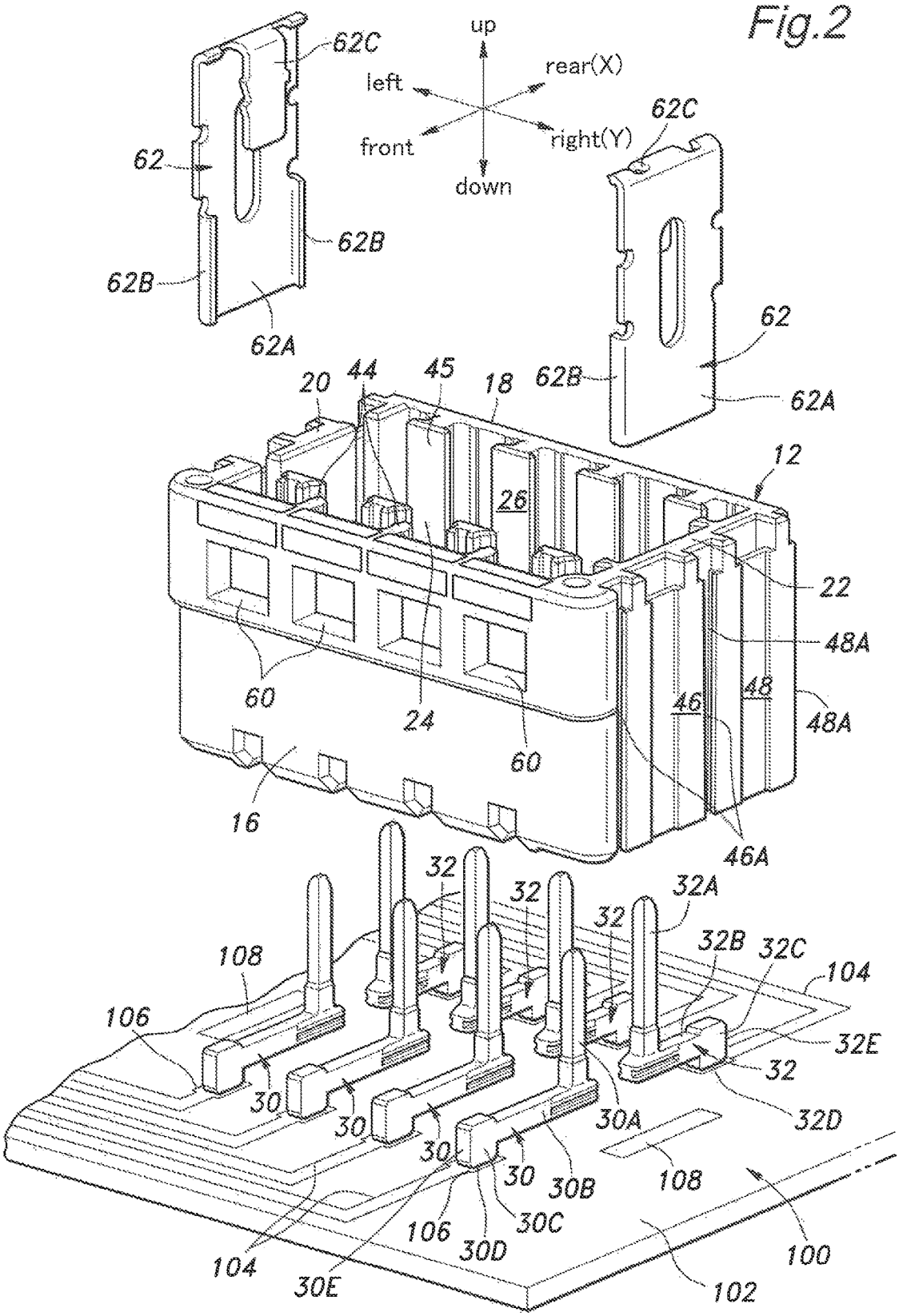
FIG. 2 is an exploded perspective view showing the dual in-line type surface mount connector used in the straight mounting form in accordance with the embodiment of the present invention.
Figure 3:
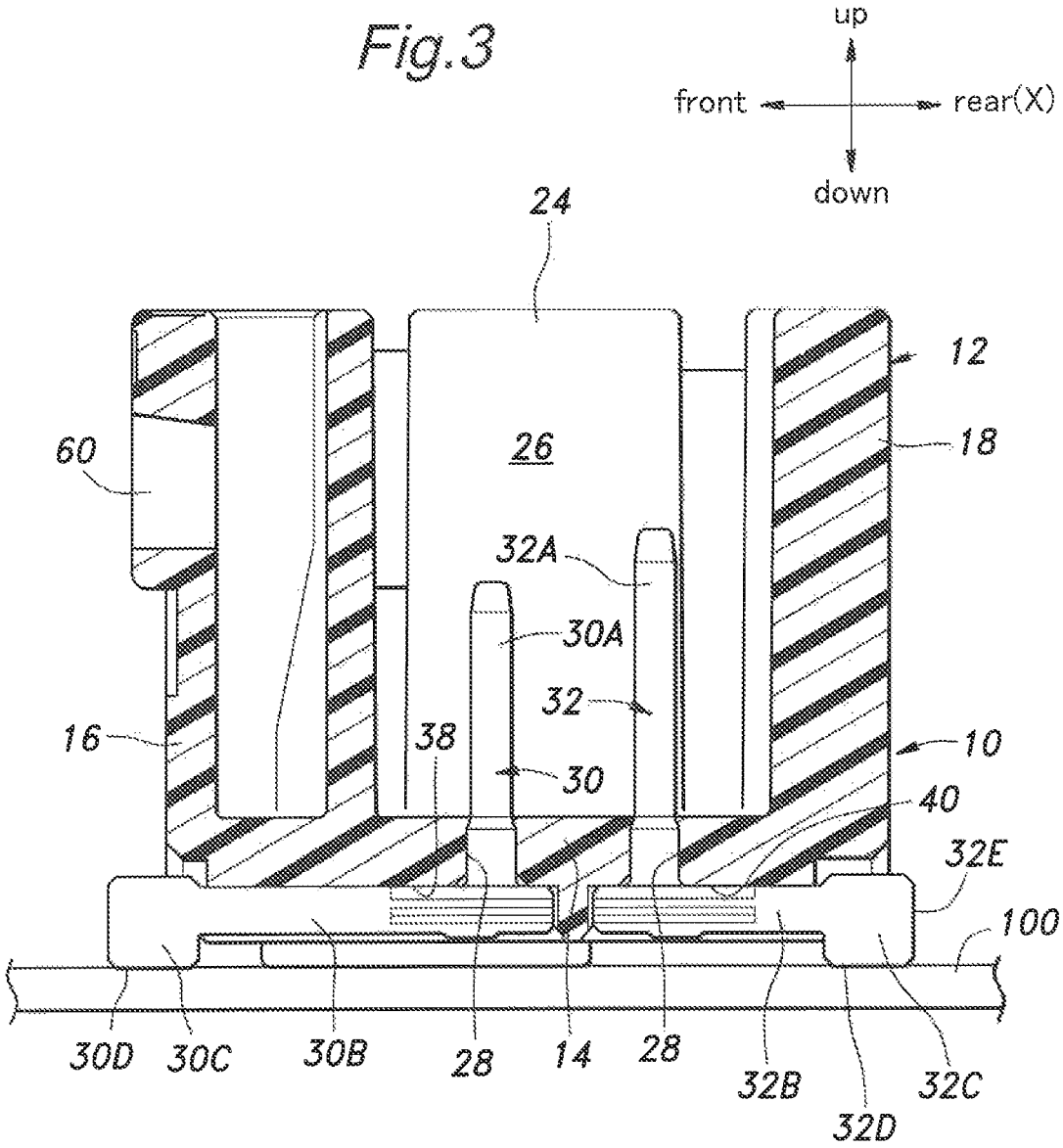
FIG. 3 is a cross-sectional view showing the dual in-line type surface mount connector used in the straight mounting form in accordance with the embodiment of the present invention.

The substrate side housing 12 is commonly used for both a dual in-line type surface mount connector and a single inline type surface mount connector. In the dual in-line type surface mount connector, terminals of the surface mount connector 10 (dual in-line terminals 30, 32) are electrically connected to the printed board 100 at connection points (terminal connection lands 106) arranged in two single rows on the both sides in an X axis direction (which will be described later) and at regular intervals in a Y axis direction (which will be described later), respectively, as shown in FIGS. 1 to 3. In the single inline type surface mount connector, terminals of the surface mount connector 10 (single in-line terminals 34, 36) are electrically connected to the printed board 100 at connection points (terminal connection lands 106) arranged in a single row on one side in the X axis direction (which will be described later) and at regular intervals in the Y axis direction (which will be described later) as shown in FIGS. 4 and 5.

The substrate side housing 12 is a plastic molded product which includes a rectangular terminal mount wall 14, four side walls 16, 18, 20, 22 standing from the respective sides (four sides) of the terminal mount wall 14 (see FIG. 3), and has a rectangular parallelepiped shape with an opening 24 on one side remote from the terminal mount wall 14. The substrate side housing 12 defines a connector introduction chamber 26, which is a single rectangular parallelepiped shape space, into which the multiple (four in the present embodiment) plug connectors 70 are allowed to be detachably inserted through the opening 24 on the side remote from the terminal mount wall 14.

Figure 4:
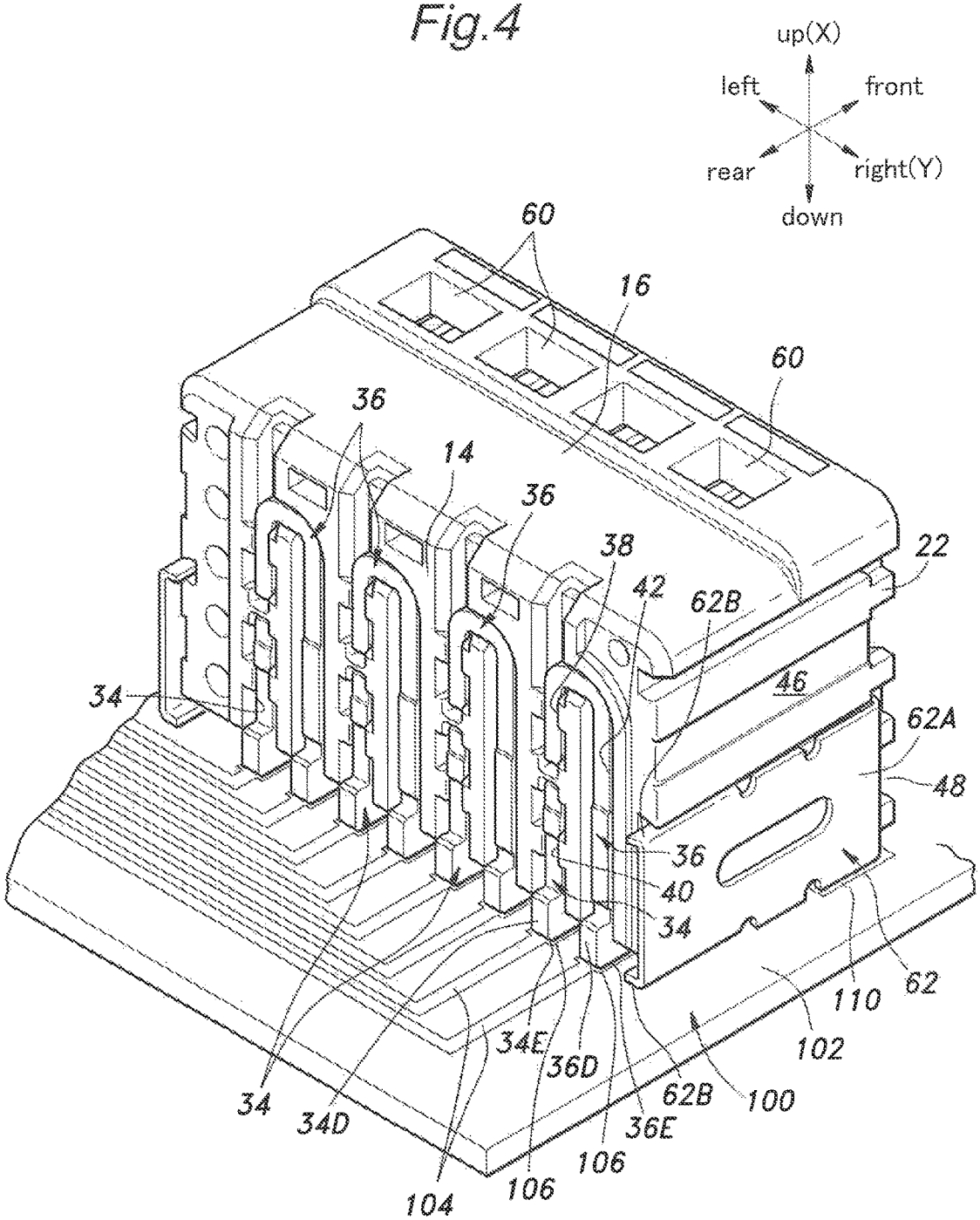
FIG. 4 is a perspective view showing a single in-line type surface mount connector used in a right-angle mounting form in accordance with one embodiment of the present invention.
Figure 5:
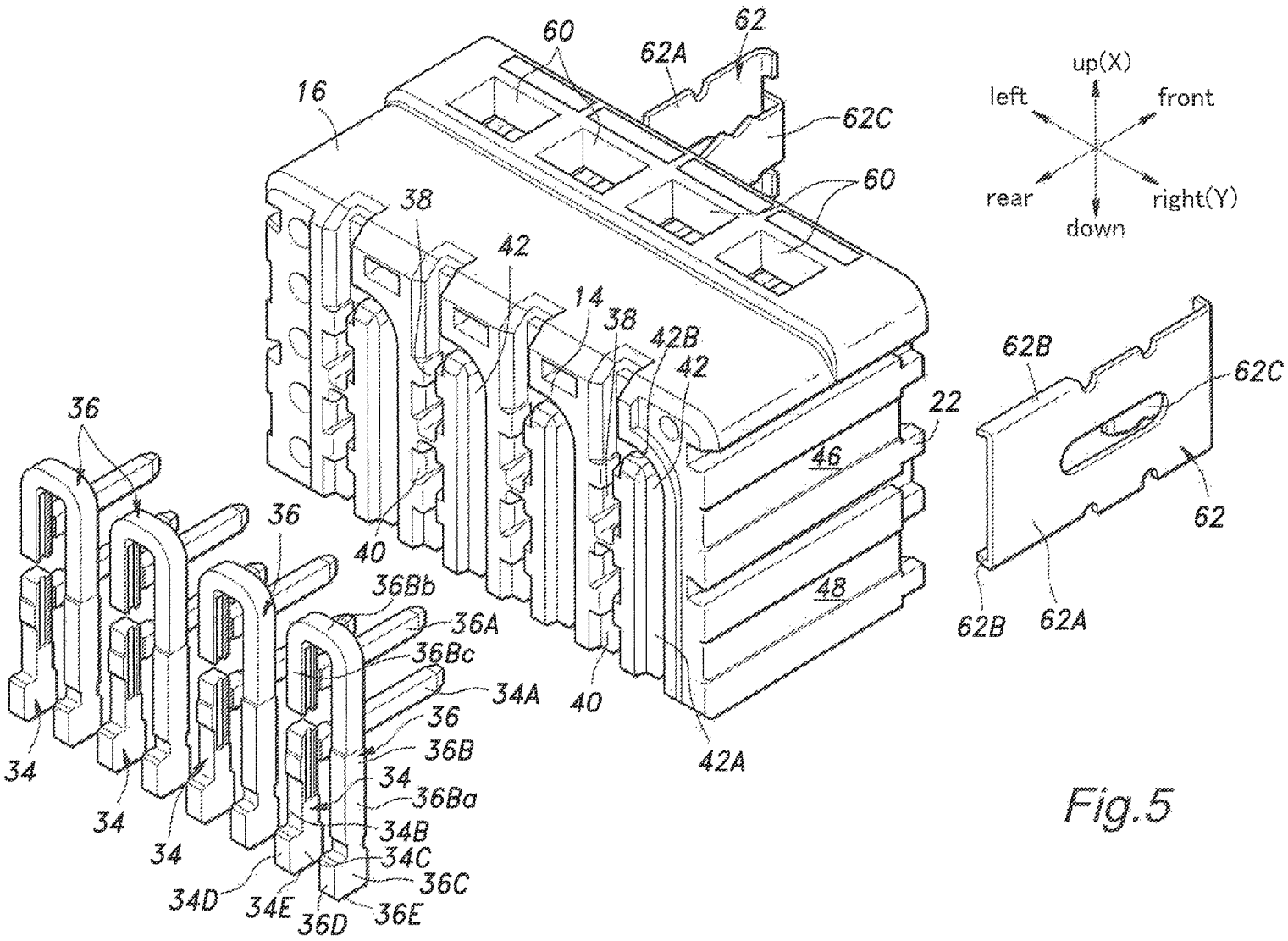
FIG. 5 is an exploded perspective view showing the single in-line type surface mount connector used in the right-angle mounting form in accordance with the embodiment of the present invention.

When the surface mount connector 10 is used in the straight mounting form as shown in FIGS. 1 to 3, the opening 24 opens upwards from the printed board 100 so that the plug connectors 70 are allowed to be inserted into the connector introduction chamber 26 from above the surface mount connector, whereas when the surface mount connector is used in the right-angle mounting form as shown in FIGS. 4 and 5, the opening 24 is located on a front side of the printed board 100 and the plug connectors 70 are allowed to be inserted sideways from the front side into the connector introduction chamber 26.

As shown in FIG. 1, the four plug connectors 70 are arranged in the left-right direction. Each plug connector 70 includes a box-shaped plug housing 72 made of an electrically insulated plastic, and is configured to be inserted into the connector introduction chamber 26 guided by guide-rails 44, 45 which arm formed on inner wall surfaces of the side walls 16, 18, respectively. Each plug housing 72 includes two female terminals (not shown) therein such that, when the plug housing 72 is inserted into the connector introduction chamber 26, the female terminals are connected to two rows of male terminals (dual in-line terminals 30, 32 or single in-line terminals 34, 36) on the surface mount connector 10, where the two rows are separated from each other in the X axis direction as described later.

Each plug housing 72 includes an integrally formed plastic elastic deformation plate 74 with a double-supported beam structure, such that, when the plug housing is inserted in the surface mount connector used in the straight mounting form, the elastic deformation plate 74 is located on the front side with respect to the printed board 100, and when the plug housing is inserted in the surface mount connector used in the surface mount connector used in the right-angle mounting form, the elastic deformation plate 74 is located remote from the upper side of the printed board 100. The elastic deformation plate 74 includes an integrally formed engaging projection 76 at an intermediate position thereof. When the plug housing is inserted in the surface mount connector, the engaging projection 76 is displaced because the elastic deformation plate 74 is elastically deformed in such a manner as to have an arcuate cross section, and then detachably engages in a lock opening 60 defined through the side wall 16 of the substrate side housing 12.

In this way, the substrate side housing 12 is provided with a lock part configured such that the plug housings 72 are allowed to engage in the lock openings 60 for detachably locking the plug housings 72 in an inserted position. The lock part is formed in one (16) of the two side walls 16, 18 which are separated from each other in the X axis direction (described later).

A detach tab 78 protrudes from the upper part of the elastic deformation plate 74. The detach tab 78 is pressed to deform the elastic deformation plate 74 to have an arcuate cross section, thereby disengaging the engaging projection 76 from the lock opening 60.

Turning beck to the description of the surface mount connector 10, the terminal mount wall 14 includes a wall member extending in a plane defined by mutually orthogonal X and Y axis. In the present embodiment, when the surface mount connector is used in the straight mounting form, the X axis extends in the front-rear direction and the Y axis extends in the left-right direction as shown in FIGS. 1 to 3, whereas, when the surface mount connector is used in the right-angle mounting form, the X axis extends in the up-down direction (vertical direction) and the Y axis extends in the left-right direction as shown in FIGS. 4 and 5.

Multiple terminal mount holes 28 are defined through the terminal mount wall 14 as shown in FIG. 3. The dual in-line terminals 30 and 32 (see FIG. 1 to 3) or the single in-line terminals 34 and 36 (see FIGS. 4 and 5) are inserted into the terminal mount bole 28. Being inserted in the terminal mount hole 28, both the dual in-line terminals 30, 32 and the single in-line terminals 34, 36 are arranged in two rows, which are a prescribed distance apart from each other in the X axis direction, such that each row includes four terminals arranged in alignment with one another and at regular intervals in the Y axis direction. As a result, the dual in-line terminals 30, 32 or the single in-line terminals 34, 36 are arranged in two rows, which are separated from each other in the front-rear direction in the case of the straight mounting form, and in the up-down direction in the case of the right-angle mounting form.

Each set of the dual in-line terminals 30, 32 and the single in-line terminals 34, 36 includes quadrangular prism shaped contacts 30A, 32A, 34A, 36A, substrate side extension parts 30B, 32B, 34B, 36B having one ends connected to proximal ends of the contacts 30A, 32A, 34A, 36A, respectively, and substrate side connection parts 30C, 32C, 34C, 36C provided at the other ends (tip ends) of the substrate side extension parts 30B, 32B, 34B, 36B, respectively, all these elements being integrally formed with respective terminals. The quadrangular prism shaped contacts 30A, 32A, 34A, 36A are made of an electrically conductive material such as metal and configured to protrude into the connector introduction chamber 26 so as to be electrically connected to plug contacts (not shown) of the female terminal of the plug connector 70. The substrate side extension parts 30B, 32B, 34B, 36B have a rectangular cross sectional shape, and are configured to mate with terminal mount grooves 38, 40, 42 formed on a back surface (an outer surface opposite to a surface of the connector introduction chamber 26) of the terminal mount wall 14.

As shown in FIG. 5, the terminal mount grooves 38 and 40, which are formed integrally with the substrate side housing 12, have a rectangular transverse cross-section and extend linearly in the X axis direction at respective positions of the Y axis direction. The terminal mount grooves 38 are formed on one side of the substrate side housing 12 where the side wall 16 is provided, while the terminal mount grooves 40 are formed on the opposite side of the substrate side housing 12 where the side wall 18 is provided, and the terminal mount grooves 40 is shorter than the terminal mount grooves 38. The terminal mount grooves 42, which are integrally formed with the substrate side housing 12, have a rectangular transverse cross section. Each of the terminal mount grooves 42 includes an X axis direction part 42A and a Y axis direction part 42B, where the X axis direction part 42A is located separated from the terminal mount grooves 38 and 40 in the Y axis direction and linearly extends parallel to the terminal mount grooves 38 and 40 in the X axis direction, and where the Y axis direction part 42B extends from one end of the X axis direction part 42A in the Y axis direction to reach an intermediate portion of the corresponding terminal mount groove 38, so that the X axis direction part 42A and the Y axis direction part 42B form a hook shape.

As shown in FIGS. 2 and 3, the substrate side extension parts 30B and 32B of the dual in-line terminals 30 and 32 extend linearly over their entire length from base ends of the contacts 30A, 32A in a direction (X axis direction) orthogonal to the contacts 30A, 32A. The substrate side extension parts 30B and 32B are fitted into the terminal mount grooves 38 and 40 and secured to the substrate side housing 12, respectively, in such a manner as to extend along the back surface of the terminal mount wall 14.

The dual in-line terminals 30 are disposed on the side of the side wall 16 of the substrate side housing 12 where the lock openings 60 are formed. Since the distance between the contacts 30A and the side wall 16 is longer than the distance between the contacts 32A of the other dual in-line terminals 32 and the side wall 18 in the X axis direction, the substrate side extension parts 30B are longer than the substrate side extension parts 32B.

The substrate side connection parts 30C and 32C of the dual in-line terminals 30 and 32 have a rectangular parallelepiped shape, and include surfaces 30D, 32D and surfaces 32E. When the surface mount connector is used in the straight mounting form, the surfaces 30D. 32D face the terminal connection lands 106 on the surface of the printed board 100 and are soldered thereto, whereas when the surface mount connector is used in the right-angle mounting form, the surfaces 32E face the terminal connection lands 106 on the surface of the printed board 100 and are soldered thereto. The surfaces 30D, 32D and surfaces 32E are on planes extending in mutually orthogonal directions, and each set of the surfaces 30D, 32D, and 32E constitute surfaces of a rectangular parallepiped shape.

As shown in FIGS. 4 and 5, the single in-line terminals 34 are configured such that their contacts 36A are located closer to the terminal connection lands 106 (connection points) than the contacts 36A of the other single in-line terminals 36 when viewed in the X axis direction (i.e., the contacts 36 are located on the lower side when the surface mount connector is used in the right-angle mounting form). The substrate side extension parts 34B of the single in-line terminals 34 extends linearly over their entire length from base ends of the contacts 34A in a direction orthogonal to the contacts 34A (in the X axis direction). The substrate side extension parts 34B are fitted into the terminal mount groove 40 and secured to the substrate side housing 12, respectively, in such a manner as to extend along the beck surface of the terminal mount wall 14.

The substrate side connection parts 34C of the single in-line terminals 34 have a cube shape, and include surfaces 34D and surfaces 32E. When the surface mount connector is used in the right-angel mounting form, the surfaces 34D face e the terminal connection lands 106 on the surface of the printed board 100 and are soldered thereto, whereas when the surface mount connector is used in the right-angle mounting form, the surfaces 32E face the terminal connection lands 106 on the surface of the printed board 100 and are soldered thereto. The surfaces 34D and the surfaces 34E are on planes extending in mutually orthogonal directions, and the surfaces 34D and the surfaces 34E of each substrate side connection parts 34C constitute the cube shape.

Thus, a single in-line terminal 34 and a short size dual in-line terminal 32 are the same parts having the same shape and the same size. In other words, the same parts can be commonly used as both the dual in-line terminals 32 and the in-line terminals 34.

As shown in FIGS. 4 and 5, the single in-line terminals 36 are configured such that their contacts 34A are located remote from the terminal connection lands 106 (connection points) compared to the contacts 34A of the other single in-line terminals 34 when viewed in the X axis direction (i.e., the contacts 34A are located on the upper side when the surface mount connector is used in the right-angle mounting form). The substrate side extension parts 36Ba of the single in-line terminals 34 extend linearly over their entire length from base ends of the contacts 34A in a direction orthogonal to the contacts 34A (in the X axis direction). The substrate side extension parts 34B are fitted into the terminal mount groove 40 and secured to the substrate side housing 12, respectively, in such a manner as to extend along the back surface of the terminal mount wall 14. The substrate side extension part 36B of the single in-line terminal 36 includes a first X-axis direction part 36Ba extending in the X axis direction, a Y axis direction part 36Bb extending in the Y axis direction from an end of the first X-axis direction part 36Ba over a length which corresponds to an interval at which an adjoining pair of the connection points are located, and a second X axis direction part 36Bc extending in the X axis direction in such a manner that the second X axis direction part 36Bc fold back from an end of the Y axis direction part 36Bb, so that the first X-axis direction part 36Ba, the Y axis direction part 36Bb, and the second X axis direction part 36Bc form a hook shape. The substrate side extension parts 36B are fitted into the terminal mount grooves 42 and 38 and secured to the substrate side housing 12, respectively, in such a manner as to extend along the back surface of the terminal mount wall 14.

The substrate side connection parts 36C of the single in-line terminals 36 have a rectangular parallelepiped shape, and include surfaces 36D and surfaces 36E. When the surface mount connector is used in the straight mounting form, the surfaces 36D face the terminal connection lands 106 on the surface of the printed board 100 and are soldered thereto, whereas when the surface mount connector is used in the right-angle mounting form, the surfaces 36E face the terminal connection lands 106 on the surface of the printed board 100 and are soldered thereto. The surfaces 36D and the surfaces 36E are on planes extending in mutually orthogonal directions, and each set of the surfaces 36D and 36E constitute surfaces of a rectangular parallelepiped shape.

As shown in FIGS. 1, 2, 4, and 5, the substrate side housing 12 includes the two side walls 20 and 22, which are separated from each other in the Y axis direction, and on each of the two side walls 20 and 22, a first reinforcement plate mount part 46 and a second reinforcement plate mount part 48 are provided at two different positions apart from each other in the X axis direction. A reinforcement plate 62 is allowed to be mounted to each of the two first and the two second reinforcement plate mount parts 46, 48. On each of the side walls 20 and 22, the first reinforcement plate mount part 46 and second reinforcement plate mount part 48 have respective pairs of mount grooves 46A, 48A on the outer wall surface such that each pair of the mount grooves 46A or 48A are separated from each other by half the size of the outer surface of the side wall 20, 22 measured in the X axis direction (the front-rear direction when the surface mount connector is used in the straight mounting form). The mount grooves 46A, 48A extend in parallel with each other in the up-down direction when the surface mount connector is used in the straight mounting form. In such a configuration, the first reinforcement plate mount parts 46 are located closer to the lock openings 60 than the second reinforcement plate mount parts 48.

As shown in FIGS. 2 and 5, a reinforcement plate 62 includes a rectangular plate main part 62A, two engagement pieces 62B, and an elastic clip piece 62C. The rectangular plate main part 62A has a short width (a width in the X axis direction) of approximately half the size of the outer wall surfaces of the side walls 20 and 22 in the X axis direction (in the front to rear direction when the surface mount connector is used in the straight mounting form), and a long width of substantially the same as the size the outer wall surfaces of the side walls 20, 22 in the up-down direction when the surface mount connector is used in the straight mounting form. The two engagement pieces 62B are formed by bending both edge portions on the short width sides of the plate main part 62A by approximately 90 degrees so as to extend in the long width direction. The elastic clip piece 62C is formed by banding an edge portion at one end of the longitudinal direction of the plate main part 62A by approximately 180 degrees so as to be folded back to the same side as the engagement pieces 62B. Each reinforcement plate 62 is placed at a position in the X-axis direction by engaging the engagement pieces 62B with the corresponding mount grooves 46A, 48A of the first or second reinforcement plate mount part 46, 48, and is secured to the substrate side housing 12 by sandwiching the side wall 20 or 22 between the plate main part 62A and the clip piece 62C. The mount grooves 46A and 48A may be dovetail grooves into which the engagement pieces 62B are fitted.

The reinforcement plate 62 can be used in common with a reinforcement plate for a surface mount connector including terminals in one row, such as one disclosed in JP2014-165091A.

The dual in-line terminals 30 and 32 are used in the surface mount connector 10 in the straight mounting form as shown in FIGS. 1 to 3. The dual in-line terminals 30 and 32 is fixed onto the surface mount connector 10 by soldering their surfaces 30D and 32D of the substrate side connection parts 30C and 32C to the corresponding terminal connection lands 106.

Furthermore, when the surface mount connector is used in the straight mounting form, the reinforcement plates 62 are mounted to the first reinforcement plate mount parts 46 located on the side closer to the lock openings 60 so that the lower edges of the reinforcement plates 62 abut the surface of the printed board 100, respectively. Soldering parts 108 are formed of the same metal layer as the conductor pattern 104 on the insulated substrate 102 at locations where the lower edges of the reinforcement plates 62 abut the surface of the printed board 100. Thus, the lower edges of the reinforcement plates 62 are soldered to the soldering parts 108. As a result, the reinforcement plates reinforce the fixation of the surface mount connector 10 to the printed board 100.

When the surface mount connector is used in the straight mounting form, the reinforcement plates 62 can be fixed to the printed board 100 at their lower sides regardless of whether the reinforcement plates are attached to either the first reinforcement plate mount parts 46 or the second reinforcement plate mount parts 48. However, the fixation of the surface mount connector 10 to the printed board 100 should be reinforced on the side closer to the side wall 16 where an unlocking operation force and a force of tension (tensile force) are exerted by a cable (not shown) connected to the plug connector 70. For this reason, the reinforcement plates 62 are mounted on the first reinforcement plate mount parts 46 closer to the side wall 16 so as to reinforce the fixation of the surface mount connector 10 to the printed board 100 on the side closer to the side wall 16.

This configuration does not need to use a thick reinforcement plate 62, and uses a reinforcement plate 62 having a width of approximately half the size of the outer surfaces of the side walls 20, 22 in the X axis direction (a minimized reinforcement plate), which results in a reduction of material costs.

When the surface mount connector 10 is used in the right-angle mounting form, as shown in FIGS. 4 and 5, the single in-line terminals 34 and 36 are used and fixed onto the surface mount connector 10 by soldering the surfaces 34E and 36E of the substrate side connection parts 34C and 36C to the corresponding terminal connection lands 106.

Furthermore, when the surface mount connector is used in the right-angle mounting form, the reinforcement plates 62 are mounted to the second reinforcement plate mount parts 48 located on the side closer to the printed board 100 so that the lower edges (long sides) of the reinforcement plates 62 abut the surface of the printed board 100. Soldering parts 110 are formed of the same metal layer as the conductor pattern 104 on the insulated substrate 102 at locations where the lower edges of the reinforcement plates 62 abut the surface of the printed board 100. Thus, the lower edges of the reinforcement plates 62 are soldered to the soldering parts 108. As a result, even when the reinforcement plate 62 has a width of approximately half the size of the outer surfaces of the side walls 20, 22 in the X axis direction, the reinforcement plates can properly reinforce the fixation of the surface mount connector 10 to the printed board 100.

In the above described configuration, by choosing the two first or the two second reinforcement plate mount parts 46, 48 to which the reinforcement plates 62 are mounted depending on whether the surface mount connector is used in the straight mounting form or in the right-angle mounting form, the reinforcement plates 62 can properly reinforce the fixation of the surface mount connector 10 to the printed board 100 in the both cases where the surface mount connector is used in the straight mounting form and used in the right-angle mounting form. Furthermore, by configuring the reinforcement plates 62 to have a width of approximately half the size of the outer surfaces of the side walls 20, 22 in the X axis direction, the reinforcement plates 62 to be mounted to the first reinforcement plate mount parts 46 and those to be mounted to the second reinforcement plate mount parts 48 can be the same part having the same shape and the same size, which eliminates the need to prepare two or more different reinforcement plates. 62.

Figure 6:
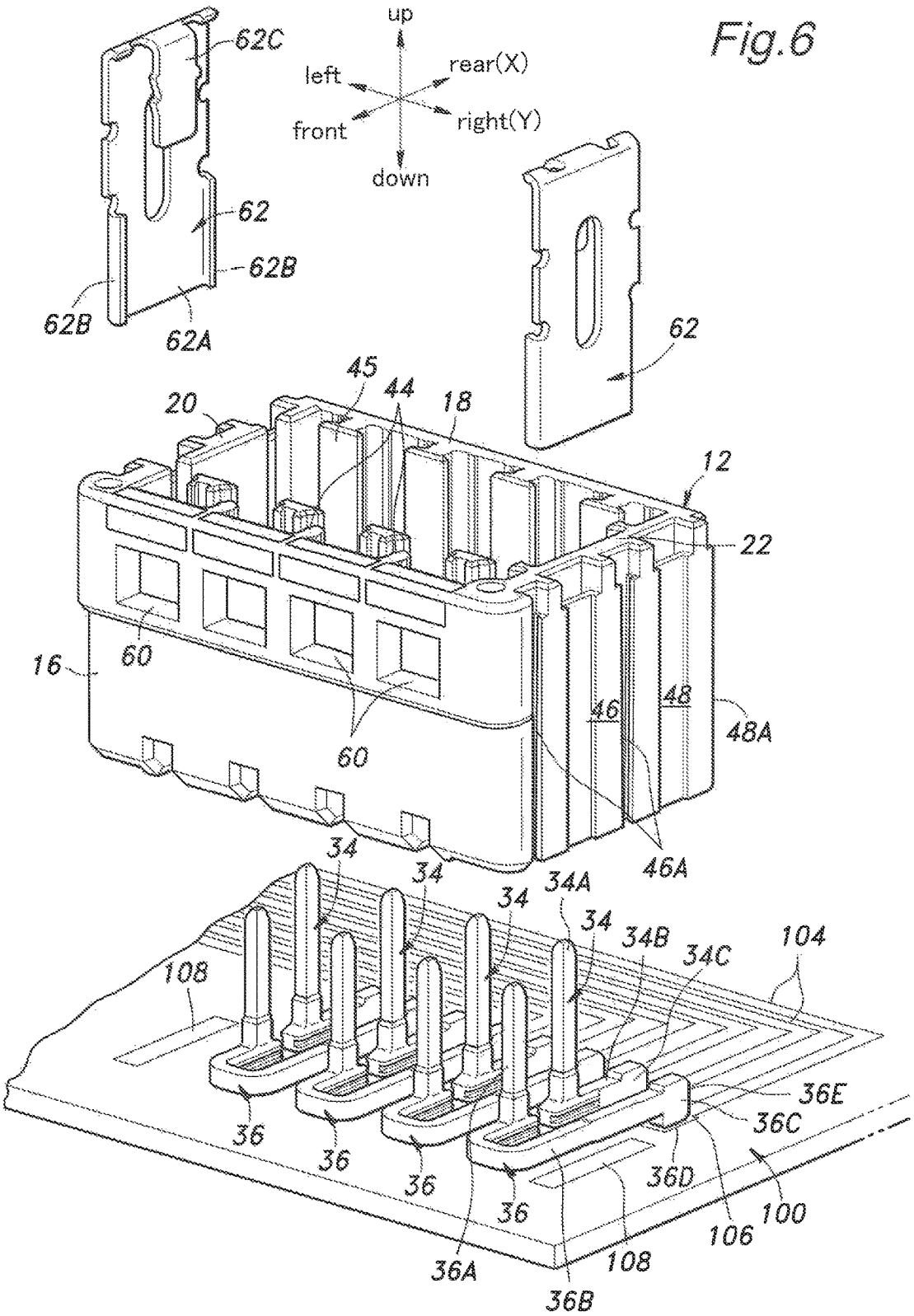
FIG. 6 is an exploded perspective view showing a single in-line type surface mount connector used in the straight mounting form in accordance with one embodiment of the present invention.
Figure 7:
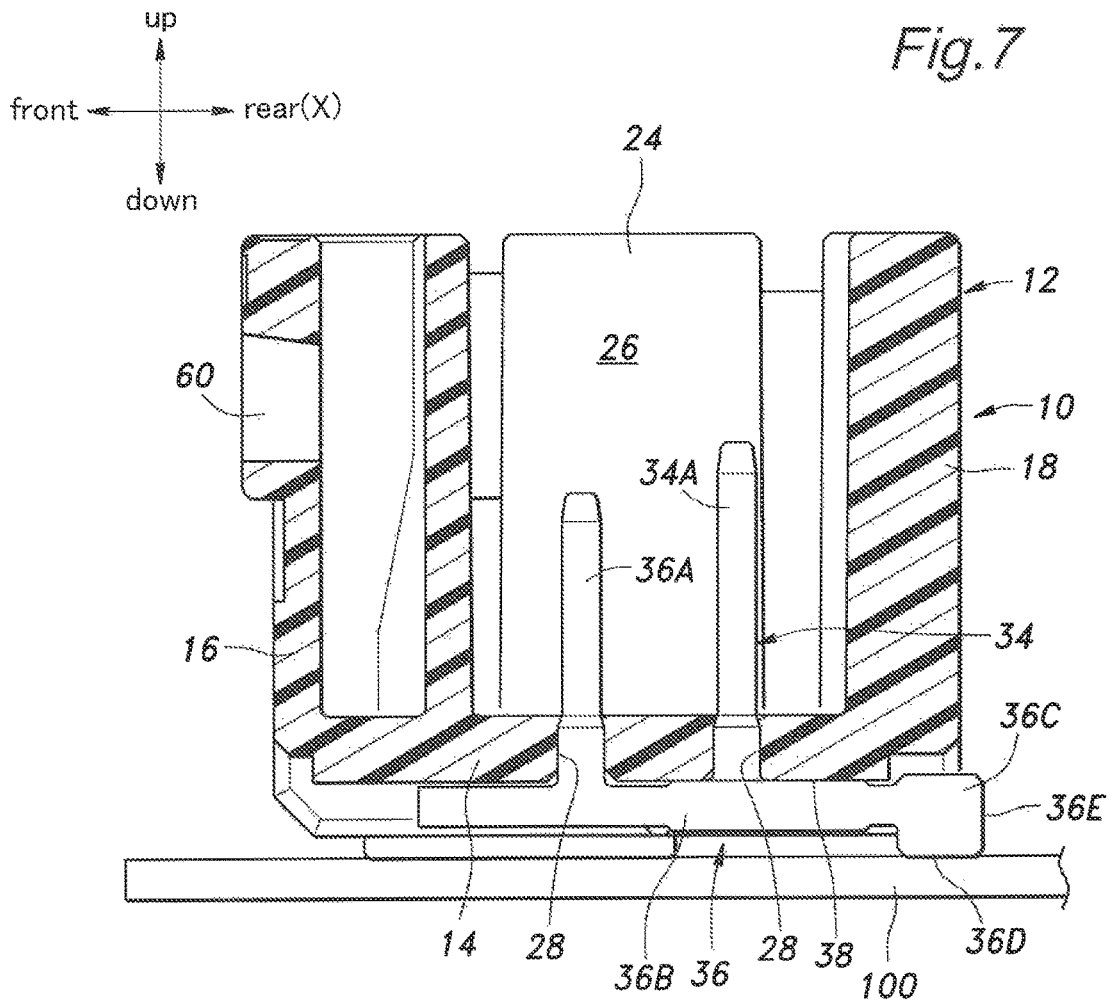
FIG. 7 is a cross-sectional view showing the single in-line type surface mount connector used in the straight mounting form in accordance with the embodiment of the present invention.

Not only the dual in-line type surface mount connector as described above but also a single in-line type surface mount connector may be used in the straight mounting form as shown in FIGS. 6 and 7. In the single in-line type surface mount connector, single in-line terminals 34 and 36 are used. The reinforcement plates 62 are preferably mounted to the first reinforcement plate mount parts 46 closer to the lock part.

In this way, by using the linear single in-line terminals 34 and the hook-shaped single in-line terminals 36, despite the terminals 34 arranged in two rows, the single in-line type connector can be realized both in the straight mounting form and in the right-angle mounting form.

Figure 8:
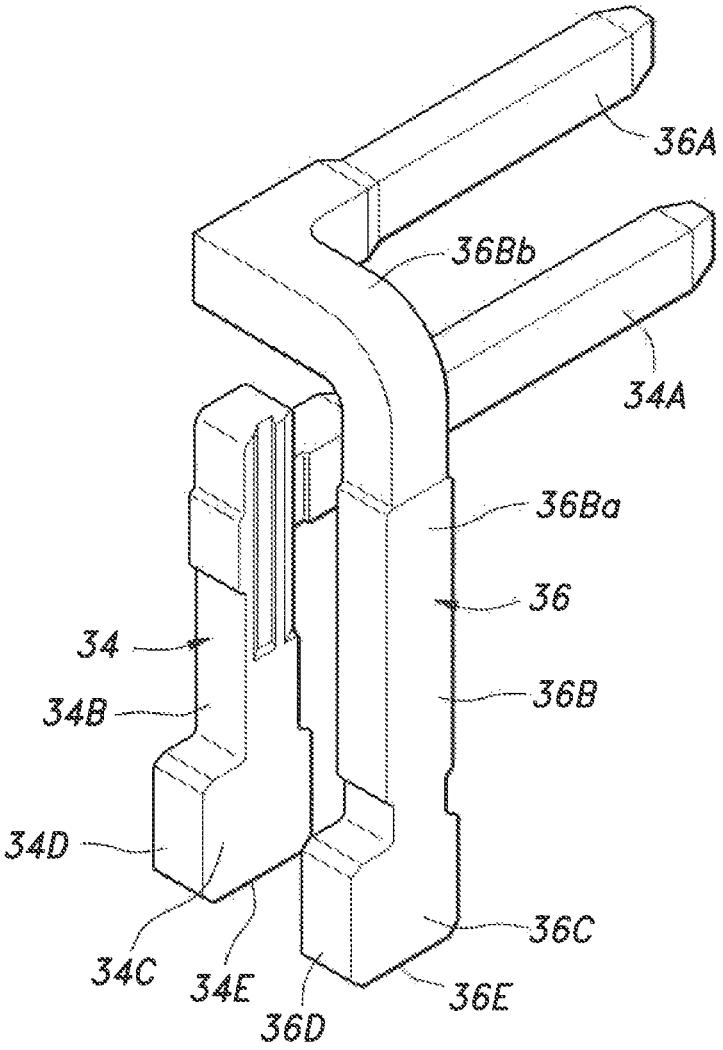
FIG. 8 is a perspective view showing a terminal used in a surface mount connector in accordance with another embodiment of the present invention.

The present disclosure has been described with reference to the specific embodiment. However, as will be understood by those skilled in the art, the invention is not intended to be limited to the particular details disclosed, and may be modified as appropriate without departing from the scope of the invention. For example, as shown in FIG. 8, the single in-line terminal 36 may include a book shaped substrate side extension part 36B, which includes a first X axis direction part 36Ba extending in the X axis direction and a Y axis direction part 36Bb extending in the Y axis direction from an end of the first X axis direction part 36Ba such that the Y axis direction part 36Bb has the same length as an interval at which adjoining connection points are located. The number of terminals is not limited to 2×4, but may be 2×N (N is a positive integer) as long as they are arranged in two rows.

All elements of the embodiments as described above are not necessarily essential, and one or more of them can be eliminated or selected as appropriate without departing from the scope of the present invention.

GLOSSARY

10 surface mount connector
12 substrate side housing
14 terminal mount wall
16 side wall
18 sides wall
20 side wall
22 sides wall
24 opening
26 connector introduction chamber
28 terminal mount hole
30 dual in-line terminal
30A contact
30B substrate side extension part
30C substrate side connection part
30D surface
30E surface
32 dual in-line terminal
32A contact
32B substrate side extension part
34 single in-line terminal
34A contact
34B substrate side extension part
34C substrate side connection part
34D surface
34E surface
36 single in-line terminal
36A contact
36B substrate side extension part
36Ba first X-axis direction part
36Bb Y-axis direction part
36Bc second X-axis direction part
36C substrate side connection part
36D surface
36E surface
38 terminal mount groove
40 terminal mount groove
42 terminal mount groove
42A X-axis direction part
42B Y-axis direction part
44 guide-rail
45 guide-rail
46 first reinforcement plate mount part
46A mount groove
48 second reinforcement plate mount part
48A mount groove
60 lock opening
62 reinforcement plate
62A plate main put
62B engagement piece
62C clip piece
70 plug connector
72 plug housing
74 elastic deformation plate
76 engaging projection
78 detach tab
100 printed board
102 insulated substrate
104 conductor pattern
106 terminal connection land
108 soldering part
110 soldering part

The invention claimed is:

1. A surface mount connector comprising:

a box-shaped electrically insulating substrate side housing with an opening on one side, the substrate side housing including a rectangular terminal mount wall, and four side walls standing from respective four sides of the terminal mount wall;

a plurality of electrically conductive terminals provided on the terminal mount wall; and a plug connector including a plug housing configured to be detachably inserted into the substrate housing, wherein the substrate side housing is capable of being mounted on a printed hoard 100 such that the surface mount connector is used either in a straight mounting form in which the opening opens upwards front the printed board, or in a right-angle mounting form in which the opening opens sideways with respect to the printed board, wherein the terminal mount wall is a wall extending in a plane defined by mutually orthogonal X and Y axes, wherein the terminals are arranged in two rows, the rows being apart from each other in an X axis direction, such that the terminals in each row are in alignment with one another in a Y axis direction, wherein the four side walls of the substrate side housing consist of two first side walls which are separated from each other in the X axis direction, and two second side walls which are separated from each other in the Y axis direction, wherein a lock part is provided on one of the two first side walls for detachably locking the plug housing in an inserted position, wherein, on each of the second side walls, a first reinforcement plate mount part and a second reinforcement plate mount part are provided at two different positions apart from each other in the X axis direction, and a reinforcement plate is mounted to each of the two first and the two second reinforcement plate mount parts, and wherein the reinforcement plates mounted to the two first reinforcement plate mount parts and/or the two second reinforcement plate mount parts have respective outer edges which abut and are fixed to the printed board.

2. The surface mount connector according to claim 1, wherein each reinforcement plate has a width of approximately half the size of outer surfaces of the second side walls in the X axis direction.

3. The surface mount connector according to claim 1, wherein the surface mount connector is a single in-line type connector in which the terminals are electrically connected to the printed board at connection points arranged in a single row, the row being; located on one side of the printed board in the X axis direction, the terminals in the row being located at regular intervals in the Y axis direction, wherein each terminal is configured to extend through the terminal mount wall into an inside of the substrate side housing, and includes:

a contact configured to be electrically connected to a terminal on the terminal on the plug housing;

a substrate side extension part including having one end connected to the contact and extending along the terminal mount wall; and a substrate side connection part provided at the other end of the substrate side extension part and configured to be electrically connected to a terminal connection land formed on the printed board, wherein, in each of the terminals in one of the two rows located closer to the connection points, the substrate side extension part only includes a liner part extending linearly in the X axis direction, and wherein, in each of the terminals in the other of the two rows located remote from the connection points, the substrate side extension part includes:

an X axis direction part extending linearly in the X axis direction; and a Y axis direction part extending in the Y axis direction and having a length corresponding to an interval at which an adjoining pair of the connection points are located, the X axis direction part and the Y axis direction part forming a hook shape.

* * * * *